United States Patent [19]

Charlot

[11] 4,234,823

[45] Nov. 18, 1980

[54] BALLAST CIRCUIT FOR LOW PRESSURE GAS DISCHARGE LAMP

[75] Inventor: Lincoln H. Charlot, Tampa, Fla.

[73] Assignee: National Computer Sign Company, Tampa, Fla.

[21] Appl. No.: 12,234

[22] Filed: Feb. 14, 1979

[51] Int. Cl.[3] ..... H05B 41/24

[52] U.S. Cl. ..... 315/224; 315/101; 315/107; 315/176; 315/DIG. 7

[58] Field of Search ..... 315/101, 105, 106, 107, 315/171, 176, 206, 208, 209 R, 219, 224, DIG. 5, DIG. 7

[56] References Cited

U.S. PATENT DOCUMENTS 3,467,887 9/1969 Skirvin ..... 315/219 X

*Primary Examiner*—Eugene R. LaRoche
*Attorney, Agent, or Firm*—Brown & Martin

[57] ABSTRACT

An improved ballast circuit for a low pressure gas discharge lamp having two filament type electrodes at opposite ends of the lamp is disclosed. The ballast circuit includes a first device for providing a high AC voltage for application across opposite electrodes of the lamp; a solid state controlled current source for providing a controlled current to the first device for enabling the first device to apply the AC voltage across the lamp electrodes to illuminate the lamp, wherein the voltage placed across said electrodes is non-sinusoidal; and a second device coupled to the first device for inhibiting the non-sinusoidal voltage from causing mercury migration in the lamp. The second device includes circuit connections for enabling current flow through only one filament of the lamp; and for biasing the voltage applied across the lamp about a DC level for balancing the effect upon mercury migration within the lamp caused by enabling current to flow through only the one filament. The controlled current source is adapted for providing an initially high current for enabling lamp warm-up following ignition and subsequently a lower constant current for enabling steady state operation of the lamp at a uniform illumination.

8 Claims, 1 Drawing Figure

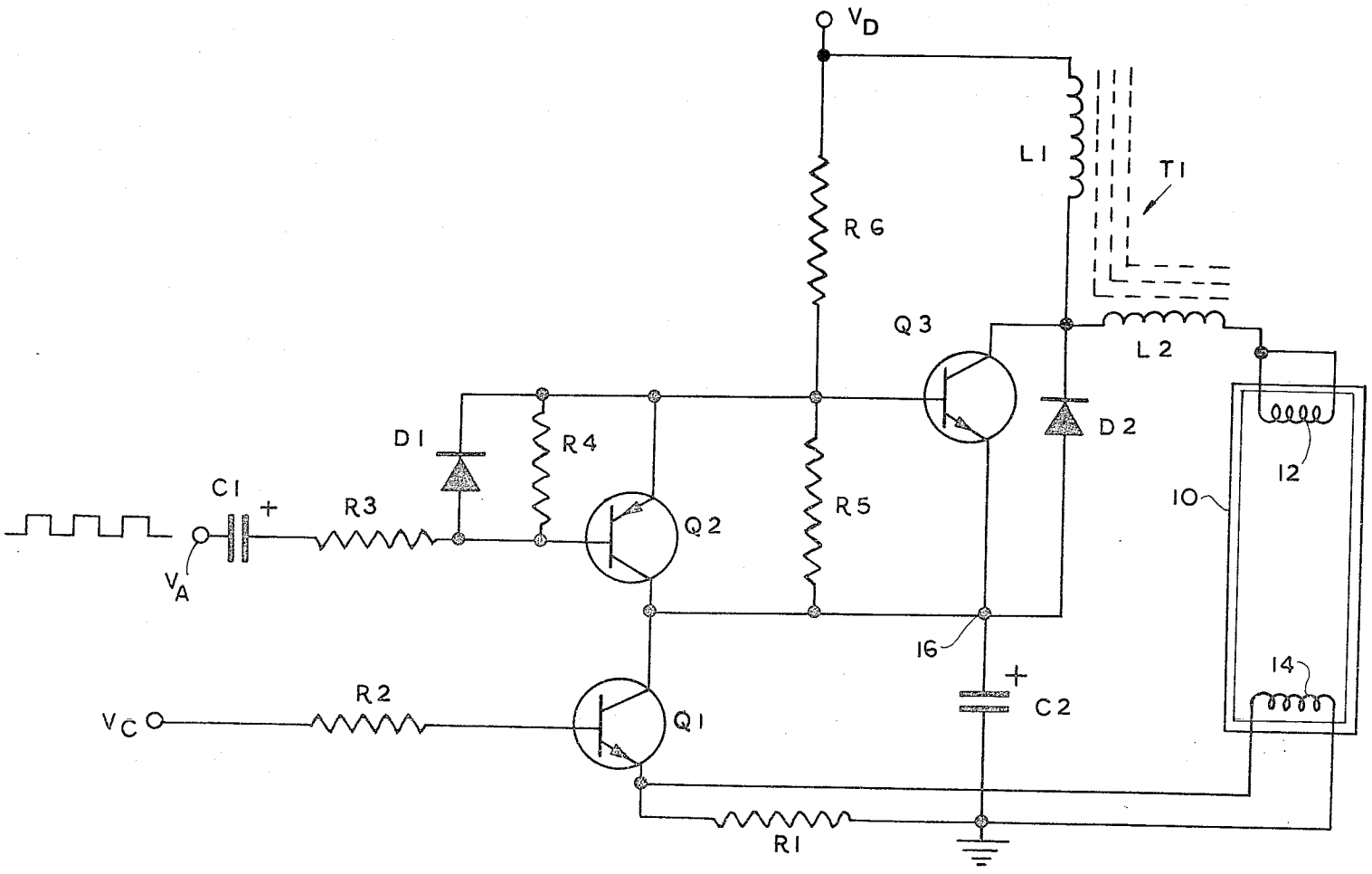
T1
L1
L2
D2
Q3
VD
R6
R5
12
14
10
16
C2
R1
Q2
Q1
R4
D1
R3
R2
C1
VA
VC

BALLAST CIRCUIT FOR LOW PRESSURE GAS DISCHARGE LAMP

BACKGROUND OF THE INVENTION

The present invention generally pertains to ballast circuits for low pressure gas discharge lamps and is particularly directed to a solid state ballast circuit that enables the lamp to quickly reach steady state illumination without causing mercury migration within the lamp.

A low pressure gas discharge lamp, such as a fluorescent lamp, typically has two filament-type electrodes at opposite ends of the lamps; and the lamp is illuminated when a high AC voltage is applied across the opposite electrodes of the lamp.

A ballast circuit for such a lamp is designed to provide a high voltage to the lamp upon turn-on to ignite the lamp, and then a constant current at a lower voltage for enabling uniform steady-state illumination. A basic prior art ballast circuit includes a loosely coupled transformer with the secondary of the transformer being connected across the opposite electrodes of the lamp. As the gas mixture within the lamp heats up, the internal resistance of the lamp between the opposite electrodes decreases. But, as the lamp draws more current, the core of the transformer becomes saturated and the voltage across its secondary winding decreases, so that following ignition of the lamp, the current supplied to the lamp decreases to a constant level for providing steady state illumination.

In one prior art ballast circuit, a capacitor is connected in series with the secondary winding of the transformer for limiting the current after ignition. However, the capacitor increases the time required for reaching steady state illumination.

In the use of these prior art circuits a sinusoidal supply voltage is applied to the primary winding of the transformer; and thereby a sinusoidal voltage is also applied across the lamp. If a non-sinusoidal voltage having other than a perfect square-wave-type waveform containing no DC component were to be applied across the lamp in these prior art circuits, it would cause mercury ions within the lamp envelope to migrate toward one of the electrodes. As a result of mercury migration and predominant accumulation at one end of the lamp, the threshold voltage for lamp ignition becomes higher, the lamp becomes less efficient, and the brightness of steady state illumination also decreases.

It is desired to use low pressure gas discharge lamps, such as fluorescent lamps, in a changeable segmented alpha-numeric character display device, wherein a single lamp is used for each segment of each character. For such an application, it is required that the lamps be quickly ignited and be rapidly heated to a bright level of illumination, and that they have a uniform steady state illumination among the several segments of the display.

The prior art ballast circuit using loosely coupled transformers or series capacitors do not cause the lamps to operate at a bright level of illumination rapidly enough for satisfactory use as a changeable segmented display device.

SUMMARY OF THE INVENTION

The present invention provides an improved ballast circuit for a low pressure gas discharge lamp having two filament-type electrodes at opposite ends of the lamp, that enables the lamp to be quickly ignited and be rapidly heated to a bright level of illumination for use in a changeable segmented display and to have a steady state illumination that remains uniform.

One ballast circuit of the present invention includes a first device for providing a high AC voltage for application across opposite electrodes of the lamp; a solid state controlled current source for providing a controlled current to the first device for enabling the first device to apply the AC voltage across the lamp electrodes to illuminate the lamp, wherein the voltage placed across said electrodes is non-sinusoidal; and a second device coupled to the first device for inhibiting the non-sinusoidal voltage from causing mercury migration in the lamp.

In the preferred embodiment of the present invention, the second device includes circuit connections for enabling current flow through only one filament of the lamp; and for biasing the voltage applied across the lamp about a DC level for balancing the effect upon mercury migration within the lamp caused by enabling current to flow through only the one filament, and for countering the effect of the application of a non-sinusoidal voltage.

The solid state controlled current source is adapted for providing an initially high current for promoting rapid lamp warm-up following ignition and subsequently a lower constant current for enabling steady state operation of the lamp at a uniform illumination. Preferably, the controlled current source includes a constant current source connected to a first terminal of the first device, and a variable current source also connected to the first terminal.

The constant current source includes a transistor having its collector connected to the first terminal; and the variable current source includes a capacitor connected to the first terminal.

Additional features of the present invention are discussed in relation to the description of the preferred embodiment.

BRIEF DESCRIPTION OF THE DRAWING

The FIGURE of the drawing is a schematic circuit diagram of the ballast circuit of the present invention.

DESCRIPTION OF THE PREFERRED EMBODIMENTS

Referring to the drawing, the ballast circuit of the present invention includes a transformer T1, having a primary winding L1 and a secondary winding L2, three transistors Q1, Q2, and Q3, two diodes D1, and D2, six resistances R1, R2, R3, R4, R5, and R6, and two capacitances C1 and C2. This circuit is adapted for illuminating a fluorescent lamp 10, which has two filament type electrodes 12 and 14 at opposite ends of the lamp.

The transistor Q3 together with the windings L1 and L2 of the transformer T1 provide a high voltage source for the lamp 10. The transistor Q3 has its collector connected to the junction of the primary and secondary windings L1 and L2, and its base coupled to the supply voltage terminal $V_D$ through the resistance R6. The emitter of the transistor Q3 is connected to the capacitance C2 at a first terminal 16, and is coupled to its base through the resistance R5. Diode D2 protects the transistor Q3 against reverse current flow. The primary winding L1 is connected between the supply voltage terminal $V_D$ and the collector of the transistor Q3. The secondary winding L2 is connected between the collector of the transistor Q3 and the electrode 12 of the lamp 10.

Current flow is enabled through the filament of the opposite electrode 14. One lead of the filament 14 is connected to circuit ground and the other lead is connected to the emitter terminal of the transistor Q1. A resistance R1 is connected in parallel with the filament of the electrode 14.

The transistor Q2 responds to a 20 KHz square wave signal provided at control terminal $V_A$ to drive the transistor Q3 to thereby provide a high AC voltage signal across the opposite electrodes of the lamp 10. The base of the transistor Q2 is coupled to the control terminal $V_A$ through a series combination of capacitance C1 and resistance R3. The collector of the transistor Q2 is connected to the first terminal 16. The emitter of the transistor Q2 is connected to the base of the transistor Q3 and is coupled to the base of the transistor Q2 through resistance R4. Diode D1 protects the transistor Q2 against reverse current flow, and provides additional drive current to the base of the transistor Q3.

The transistor Q1 and the capacitance C2 are the essential elements of a solid state controlled current source for enabling the transistor Q3 and the transformer T1 to apply the AC voltage across the lamp electrodes 12 and 14 to illuminate the lamp 10. The transistor Q1 has its collector connected to the first terminal 16 and its emitter connected to the resistor R1 and to the electrode filament 14. The base of the transistor Q1 is coupled through the resistance $R_2$ to a DC voltage terminal $V_C$ which is maintained at a level for causing the transistor Q1 to conduct a controlled amount of current equal to the voltage $V_C$ minus the voltage drop across the resistance $R_2$ minus 0.6 volts, divided by the parallel combination of the resistance R1 and the lamp filament electrode resistance 14. The capacitance C2 is connected between the first terminal 16 and circuit ground.

The 20 KHz square wave control signal is provided at control terminal $V_A$ when the lamp is to be turned on, and the transistor Q2 is turned on and off at the 20 KHz rate. During the positive portions of the square wave the transistor Q2 is off and the transistor Q3 is on; whereas during the negative portions of the square wave the transistor Q2 is on and the transistor Q3 is off. The transistor Q1 conducts the controlled amount of current continuously.

For the aforementioned segmented character display device application, power is provided to the ballast circuit continuously even when no square wave control signal is being applied to the control voltage terminal $V_A$. When no square wave signal is applied, the transistor Q2 is off and the transistor Q3 is on, so as to provide a continuous conduction path through the filament of the electrode 14 and thereby cause this filament to be heated continuously so that upon ignition, it will reach its uniform steady state brightness of illumination quickly.

When the ballast circuit is first turned on and a square wave control signal is provided at the terminal $V_A$, a high AC voltage is placed across the lamp electrodes 12 and 14 and a high initial current is provided at the first terminal 16 for igniting the lamp. The transistor Q1 is a relatively constant current source, and the capacitance C2 is a variable current source. The capacitance C2 is partially discharged when the transistor Q3 is first turned on for providing the additional current at the first terminal 16 to the emitter of the transistor Q3 that is necessary for quickly igniting the lamp 10. During steady state operation the capacitance C2 holds a portion of its charge to maintain the first terminal 16 at a constant DC voltage level. As a result, the steady state current through the lamp 10 is constant to provide a constant level of steady state illumination.

The resistance R1 is of such value in relation to the lamp filament resistance 14 as to cause the current from the collector of the transistor Q1 to decrease slightly when the lamp filament 14 temperature increases to thereby maintain the lamp 10 at a uniform brightness.

Although a non-sinusoidal voltage is applied across the lamp 10, mercury migration within the lamp is inhibited because current flow is enabled through only the one electrode filament 14 to cause mercury migration in one direction and the AC voltage applied to the lamp is DC biased by the supply voltage at terminal $V_D$ to cause mercury migration in the opposite direction.

The voltage level at the terminal $V_D$ is selected to counterbalance the mercury migration in the one direction. To finely balance the mercury migration, the duty cycle of square wave control signal is slightly unbalanced.

I claim:

1. A ballast circuit for a low pressure gas discharge lamp having two filament-type electrodes at opposite ends of the lamp, comprising;

first means for providing a high AC voltage for application across opposite electrodes of the lamp;

a solid state controlled current source for providing a controlled current to the first means for enabling the first means to apply said AC voltage across said lamp electrodes to illuminate said lamp, wherein the voltage placed across said electrodes is non-sinusoidal; and second means coupled to the first means for inhibiting said non-sinusoidal voltage from causing mercury migration in said lamp.

2. A ballast circuit according to claim 1, wherein the second means comprises;

means for enabling current flow through only one filament of the lamp; and means for biasing the voltage applied across the lamp about a DC level for balancing the effect upon mercury migration within the lamp caused by enabling current to flow through only the one filament.

3. A ballast circuit according to claim 2, wherein the second means further comprises:

means for unbalancing the duty cycle of the AC voltage to finely balance the effects on mercury migration within the lamp caused by the biasing of the applied voltage and by enabling current to flow through only the one filament.

4. A ballast circuit according to claim 1, wherein the controlled current source is adapted for providing an initially high current for promoting rapid lamp warm up following ignition and subsequently a lower constant current for enabling steady state operation of said lamp at a uniform illumination.

5. A ballast circuit according to claim 4, wherein the controlled current source comprises;

a constant current source connected to a first terminal of the first means, and a variable current source connected to said first terminal.

6. A ballast circuit according to claim 5 wherein the constant current source comprises a transistor having its collector connected to said first terminal; and the variable current source comprises a capacitor connected to said first terminal.

7. A ballast circuit according to claim 6, wherein the filament at one end of the lamp has two terminals; and the transistor has its emitter directly connected to one filament terminal and coupled to the other filament terminal which is in common with circuit ground through a resistance of such value in relation to the lamp filament resistance as to cause the current from the transistor collector to decrease when the lamp filament temperature increases.

8. A ballast circuit according to claim 5 wherein the filament at one end of the lamp has two terminals; and the constant current source comprises a transistor having its collector connected to said first terminal of the first means, and its emitter directly connected to one filament terminal and coupled to the other filament terminal which is in common with circuit ground through a resistance of such value in relation to the lamp filament resistance as to cause the current from the collector to decrease when the lamp filament temperature increases.

* * * * *